US006318270B1

(12) United States Patent
Weber

(10) Patent No.: US 6,318,270 B1
(45) Date of Patent: Nov. 20, 2001

(54) SAFETY ELEMENT PARTICULARLY FOR A FUZE OF A SUBSTANTIALLY NON-SPINNING PROJECTILE

(75) Inventor: Adolf Weber, Neunkirchen (DE)

(73) Assignee: Rheinmetall W & M GmbH, Unterlüss (DE)

( * ) Notice: Subject to any disclaimer, the term of this patent is extended or adjusted under 35 U.S.C. 154(b) by 0 days.

(21) Appl. No.: 09/607,944

(22) Filed: Jun. 30, 2000

(30) Foreign Application Priority Data

Jun. 30, 1999 (DE) ..... 199 30 045

(51) Int. Cl.[7] ..... F42C 15/24

(52) U.S. Cl. ..... 102/249; 102/233; 102/235; 102/251

(58) Field of Search ..... 102/249, 200, 102/233, 235, 251

(56) References Cited

U.S. PATENT DOCUMENTS 3,744,425 * 7/1973 Grimm ..... 102/505
4,018,164 * 4/1977 Breed et al. ..... 102/236
4,811,664 * 3/1989 Levy et al. ..... 102/226
4,901,643 * 2/1990 Rudenauer et al. ..... 102/256

* cited by examiner

*Primary Examiner*—Charles T. Jordan
*Assistant Examiner*—Jordan M Lofdahl
(74) *Attorney, Agent, or Firm*—Venable; Gabor J. Kelemen

(57) ABSTRACT

A projectile fuze includes a detonator carrier having a safety position and an armed position; a pin having a blocking position in which it holds the detonator carrier in the safety position and a releasing position in which the pin allows the detonator carrier to move into the armed position; a spring urging the pin into the releasing position; a pyrotechnical delay element exposed to hot propellant gases for causing ignition and combustion of the delay element; and a pin-supporting component maintaining the pin in the blocking position against a force of the spring. The pin-supporting component is held in the pin-maintaining state by the delay element until combustion thereof, whereby the pin is allowed to move into the releasing position upon combustion of the delay element.

6 Claims, 1 Drawing Sheet

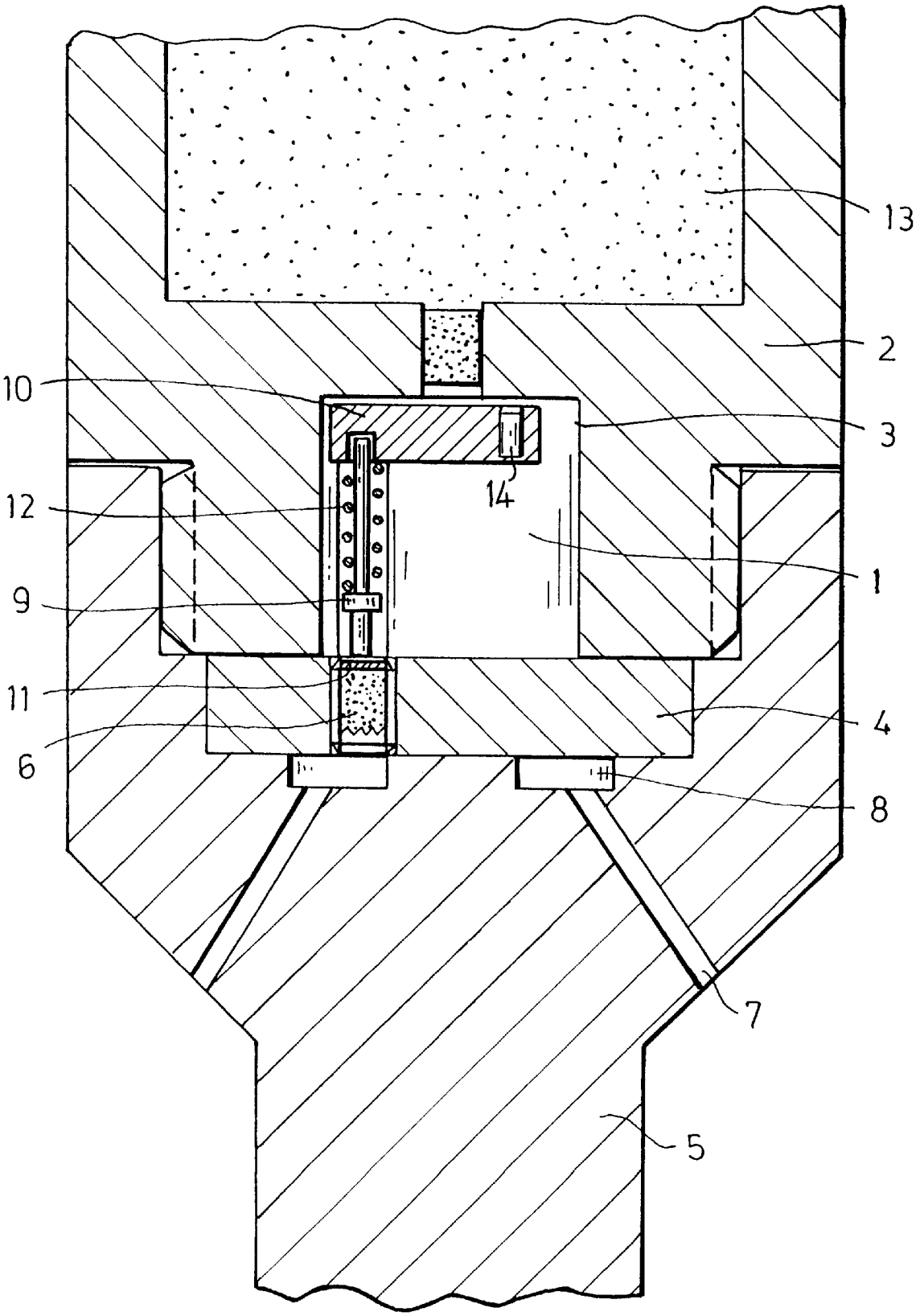
13
2
10
3
14
12
1
9
11
4
6
8
7
5

SAFETY ELEMENT PARTICULARLY FOR A FUZE OF A SUBSTANTIALLY NON-SPINNING PROJECTILE

CROSS REFERENCE TO RELATED APPLICATION

This application claims the priority of German Application No. 199 30 045.3 filed Jun. 30, 1999, which is incorporated herein by reference.

BACKGROUND OF THE INVENTION

This invention relates to a safety element for a fuze of a projectile to which no spin or only slight spin is imparted upon firing.

STANAG 4187 (NATO military standard) and MIL-STD 1316 (German military standard) require that fuze safety systems comprise at least two mutually independent safety devices, each of which prevents an unintentional safety release and thus a detonation of the ammunition by the fuze system. The conditions which make possible for at least two safety elements to respond must be derived from different, external environmental forces.

According to the classical case for ammunition fired from weapon barrels with a spin, the acceleration upon firing and the centripetal force are used as the safety release criteria. These two environmental forces are very large in relation to other forces which may be produced during storage, transport or similar effects and are entirely sufficient to provide for the safety of such fuze systems. An example is the 35 mm barrel ammunition having a firing acceleration of approximately 70,000 g and a rotary velocity of approximately 70,000 rpm.

Fuzes contained in ammunition which is fired without spin or only with a very slight spin are more difficult to secure. For example, in case of mechanical mortar fuzes an insert is used as the second safety release which is removed by the crew prior to loading. Thus, from the moment of such removal until firing only a single safety is operative (such as a dual pin system) and thus the above noted requirements are not complied with.

The case is similar for a DM 781 fuze of the 120 mm multipurpose tank ammunition. In such a fuze the carrier of the transfer charge is secured only with a dual pin system which again does not satisfy the above-discussed requirements.

SUMMARY OF THE INVENTION

It is an object of the invention to provide an improved, inexpensive safety element of the above-outlined type which is released by the gas pressure and the heat generated by the propellant. It is a further object of the invention to provide a safety element which also serves as a muzzle area safety.

This object and others to become apparent as the specification progresses, are accomplished by the invention, according to which, briefly stated, the projectile fuze includes a detonator carrier having a safety position and an armed position; a pin having a blocking position in which it holds the detonator carrier in the safety position and a releasing position in which the pin allows the detonator carrier to move into the armed position; a spring urging the pin into the releasing position; a pyrotechnical delay element exposed to hot propellant gases for causing ignition and combustion of the delay element; and a pin-supporting component maintaining the pin in the blocking position against a force of the spring. The pin-supporting Component is held in the pin-maintaining state by the delay element until combustion thereof, whereby the pin is allowed to move into the releasing position upon combustion of the delay element.

The safety device according to the invention may additionally function as a muzzle area safety and thus, for example, in the fuze DM 781 (and similar fuzes) a conventionally used clockwork mechanism may be dispensed with.

BRIEF DESCRIPTION OF THE DRAWING

The sole FIGURE is a sectional elevational view of a preferred embodiment of the invention.

DESCRIPTION OF THE PREFERRED EMBODIMENT

The FIGURE shows a projectile body 2 having a cavity 3 which accommodates the safety device 1 of the projectile. A projectile guide assembly 5 is tightened to the projectile body 2 by suitable threaded connections with the interposition of a sturdy bottom plate 4 which is thus pressed against the rear face of the projectile body 2 to prevent propellant gases from entering.

A pyrotechnical delay element 6 is secured in the bottom plate 4 by screw connection and is sealed gas tight.

Bore holes 7 and an annular recess 8 in the guide assembly 5 ensure access of propellant gases to, and ignition of, the pyrotechnical delay element 6.

A securing pin 9 firmly holds a detonator carrier 10 or a carrier of a transfer charge (for example, a rotor or slide) in the safety device 1 during storage and transport. The detonator carrier 10 supports a detonator 14 which, in the safety position, is out of alignment with the main charge 13.

In the description which follows the operation of the above-described safety device will be set forth.

Upon firing the projectile, first a preliminary safety release of the detonator carrier 10 occurs by virtue of the acceleration forces. This may be effected by a spring/mass system such as a dual pin system (not shown) conventionally used in the DM 781 fuze of a 120 mm multipurpose ammunition.

As the projectile passes through the weapon barrel, the hot propellant gases flow through the bore holes 7 into the annular groove 8 and ignite the delay element 6. Upon combustion of the delay element 6 the securing pin 9 which, during storage and transport, is held on a supporting plate 11 of the delay element 6, is axially freely movable, and thus, urged by the spring 12, moves out of a locking hole provided in the detonator carrier 10.

As a result, the detonator carrier 10 (or a carrier of a transfer charge) is freely movable and may be, for example, by means of a spring, moved into an in-line (armed) position in which the main charge 13 of the projectile may be detonated by the detonator 14.

The above-described arrangement according to the invention is in compliance with the requirements of STANAG 4187 and MIL.STD 1316 which call for two mutually independent safety elements and different environmental actuating forces, namely, an acceleration upon firing and the combustion of the propellant.

If the combustion period of the delay element 6 is set such that it corresponds to the period of safety (for example, 40 ms) after the projectile leaves the weapon tube, the safety element according to the invention may additionally assume the function of a muzzle area safety. Thus, a relatively expensive clockwork which is conventional in safety devices of this type may be dispensed with.

It will be understood that the above description of the present invention is susceptible to various modifications, changes and adaptations, and the same are intended to be comprehended within the meaning and range of equivalents of the appended claims.

What is claimed is:

1. A fuze for a projectile adapted to be accelerated by gas pressure obtained by propellant combustion, comprising (a) a detonator carrier having a safety position and an armed position;

(b) a pin having a blocking position in which said pin holds said detonator carrier in said safety position thereof and a releasing position in which said pin allows said detonator carrier to move into said armed position;

(c) a spring urging said pin into said releasing position;

(d) a pyrotechnical delay element exposed to hot propellant gases for causing ignition and combustion of the delay element by the propellant gases; and (e) a pin-supporting component maintaining said pin in said blocking position against a force of said spring; said pin-supporting component being held in the pin maintaining state by said delay element until combustion thereof, whereby said pin is allowed to move into said releasing position upon combustion of said delay element.

2. The projectile as defined in claim 1, wherein said pyrotechnical delay element has a combustion period corresponding to a muzzle area safety period.

3. The projectile as defined in claim 2, wherein said combustion period is 40 ms.

4. A projectile adapted to be accelerated by gas pressure obtained by propellant combustion, comprising (a) a projectile body;

(b) an explosive payload accommodated in said projectile body;

(c) a fuze accommodated in said projectile body and comprising (1) a detonator carrier having a safety position and an armed position;

(2) a pin having a blocking position in which said pin holds said detonator carrier in said safety position thereof and a releasing position in which said pin allows said detonator carrier to move into said armed position for detonating said explosive payload;

(3) a spring urging said pin into said releasing position;

(4) a combustible pyrotechnical delay element; and (5) a pin-supporting component maintaining said pin in said blocking position against a force of said spring; said pin-supporting component being held in the pin maintaining state by said delay element until combustion thereof, whereby said pin is allowed to move into said releasing position upon combustion of said delay element; and (d) means defining a passage leading to said delay element for admitting hot propellant gases to said delay element to cause ignition and combustion thereof.

5. The projectile as defined in claim 4, further comprising (e) a guide assembly;

(f) means for securing said guide assembly to said projectile body; and (g) a bottom plate pressed to an outer surface of said projectile body by said guide assembly; said bottom plate being connected with said fuze and protecting said fuze from propellant gas pressure upon firing the projectile.

6. The projectile as defined in claim 4, wherein said passage is provided in said guide assembly and said delay element ig supported in said bottom plate.

* * * * *